US005201835A

United States Patent [19]

Hosie

[11] Patent Number: 5,201,835

[45] Date of Patent: Apr. 13, 1993

[54] WELLHEAD SEAL WITH PROTECTIVE RIB

[75] Inventor: Stanley Hosie, Aberdeen, Scotland

[73] Assignee: ABB Vetco Gray Inc., Houston, Tex.

[21] Appl. No.: 810,751

[22] Filed: Dec. 19, 1991

[51] Int. Cl.[5] ..... F16J 15/08

[52] U.S. Cl. ..... 277/1; 277/205; 277/207 A; 277/236; 285/111; 285/921

[58] Field of Search ..... 277/1, 9, 205, 206 R, 277/207 A, 207 R, 208, 236; 285/110, 111, 307, 336, 345, 347, 917, 921

[56] References Cited

U.S. PATENT DOCUMENTS

| | | | |
|---|---|---|---|
| 3,378,269 | 4/1968 | Castor | 277/205 |
| 3,784,235 | 11/1974 | Kessler | 285/921 |
| 4,362,323 | 12/1982 | Lodder et al. | 285/111 |
| 4,709,725 | 12/1987 | Morrison | 277/236 |
| 5,076,594 | 12/1991 | Baugh | 277/207 A |

*Primary Examiner*—William A. Cuchlinski, Jr.
*Assistant Examiner*—Daniel G. DePumpo
*Attorney, Agent, or Firm*—James E. Bradley

[57] ABSTRACT

A seal member that locates between inner and outer tubular members has ribs for reducing the amount of sliding contact. The seal member is U-shaped, having inner and outer walls connected on one end by a base. Each wall has a sealing band protruding radially outward. Each wall has a rib located between the base and the sealing bands. The ribs engage the sidewall surfaces of the tubular members during installation. Each tubular member has a recess for receiving the rib to allow the seal member walls to deflect back to the proper positions once fully installed.

6 Claims, 2 Drawing Sheets

WELLHEAD SEAL WITH PROTECTIVE RIB

BACKGROUND OF THE INVENTION

1. Field of the invention

This invention relates in general to seals for wellheads, and in particular to a U-shaped seal having a rib for protecting the sealing band during the installation of the seal.

2. Description of the Prior Art

In one type of well completion, a wellhead or inner tubular member will be secured to the upper end of the well. The inner tubular member has an external shoulder and an external sidewall surface. An outer tubular member inserts down over the inner tubular member to connect pressure control equipment located above. The outer tubular member has an internal sidewall surface.

An annular space exists between the two sidewall surfaces. A seal member locates in this annular space to seal the tubular members. One type of seal has inner and outer legs or walls spaced radially apart. Each wall has a sealing band on its upper end that engages one of the sidewall surfaces. The seal is metal, and the sealing band is coated with a material to enhance sealing.

One disadvantage of this system is that when the seal is inserted over the inner tubular member, the inner sealing band will rub on the external sidewall surface as the seal is pushed downward against the shoulder. Also, when the outer tubular member inserts over the inner tubular member, the outer sealing band will rub against the internal sidewall surface during the insertion movement. The rubbing causes some of the coating to wear away.

SUMMARY OF THE INVENTION

In this invention, at least one of the walls of the seal member is provided with a rib. The rib is a small protrusion located between the base and the sealing band. During insertion, the rib will slide against the sidewall surface, deflecting the seal member wall radially. While the rib engages the sidewall surface, the deflection keeps the sealing band from contacting the sidewall surface.

A recess is provided in the sidewall surface. The recess is positioned to receive the rib approximately when the outer tubular member is fully inserted over the inner tubular member. The recess allows the wall of the seal member to spring back until the sealing band sealingly engages the sidewall surface.

In the preferred embodiment, both the inner and outer walls of the seal member have ribs. Also, preferably the sidewall surfaces of both the inner and outer tubular members have recesses for receiving the ribs.

DETAILED DESCRIPTION OF THE INVENTION

Figure 1:
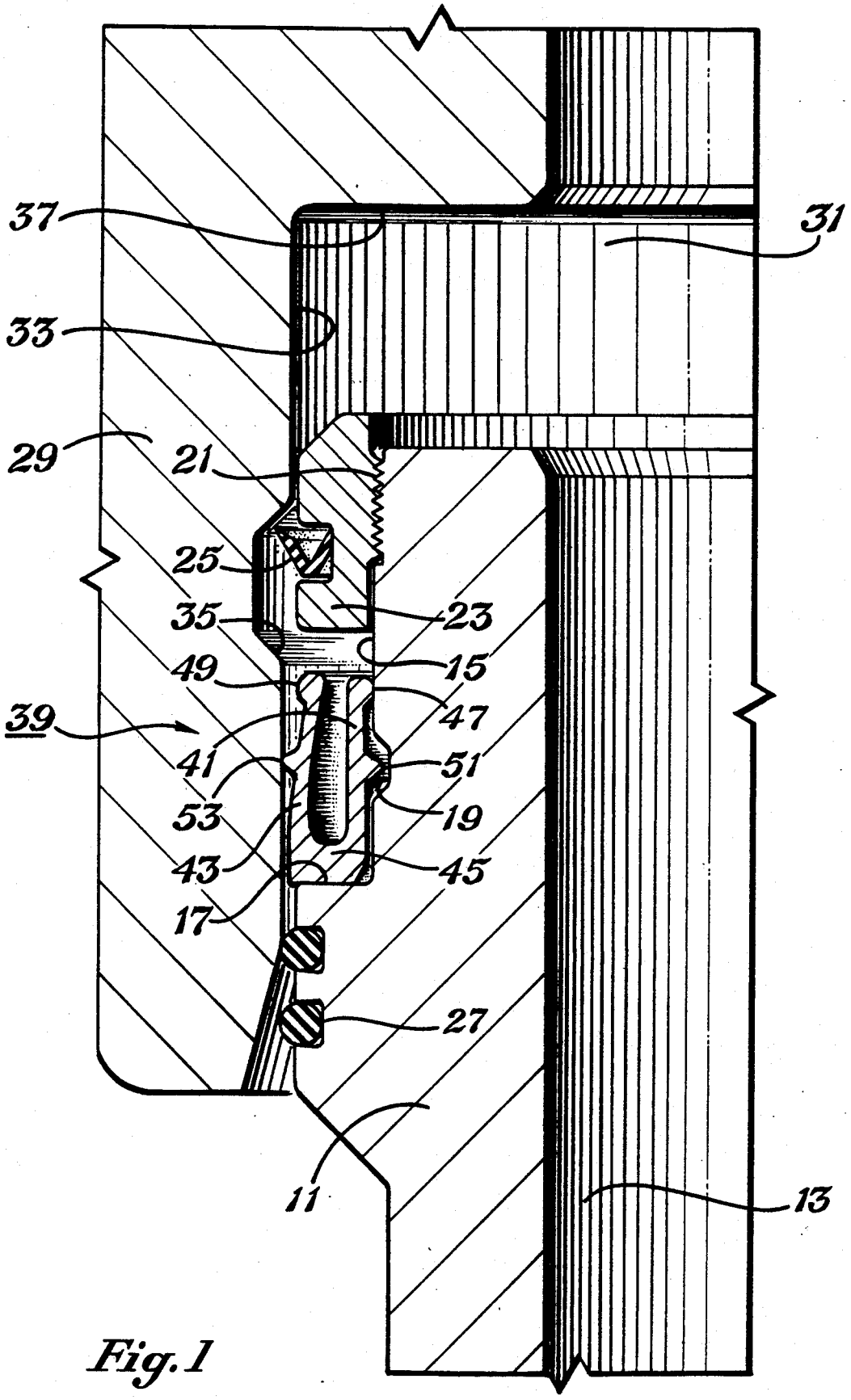
FIG. 1 is a quarter sectional view illustrating portions of a wellhead in the process of being assembled.

Referring to FIG. 1, inner tubular member 11 will normally be secured to conductor pipe extending into a well. Inner tubular member 11 has a bore 13 and an external sidewall surface 15. An upward facing shoulder 17 locates at the lower end of external sidewall surface 15. An annular recess 19 is formed in external sidewall surface 15 above shoulder 17. A set of threads 21 on the upper end will receive a seal carrier 23. Seal carrier 23 carries a wiper seal 25 having a V-shaped configuration. A pair of secondary seals 27, preferably O-rings, are located in grooves on the exterior of inner tubular member 11 below shoulder 17.

Figure 2:
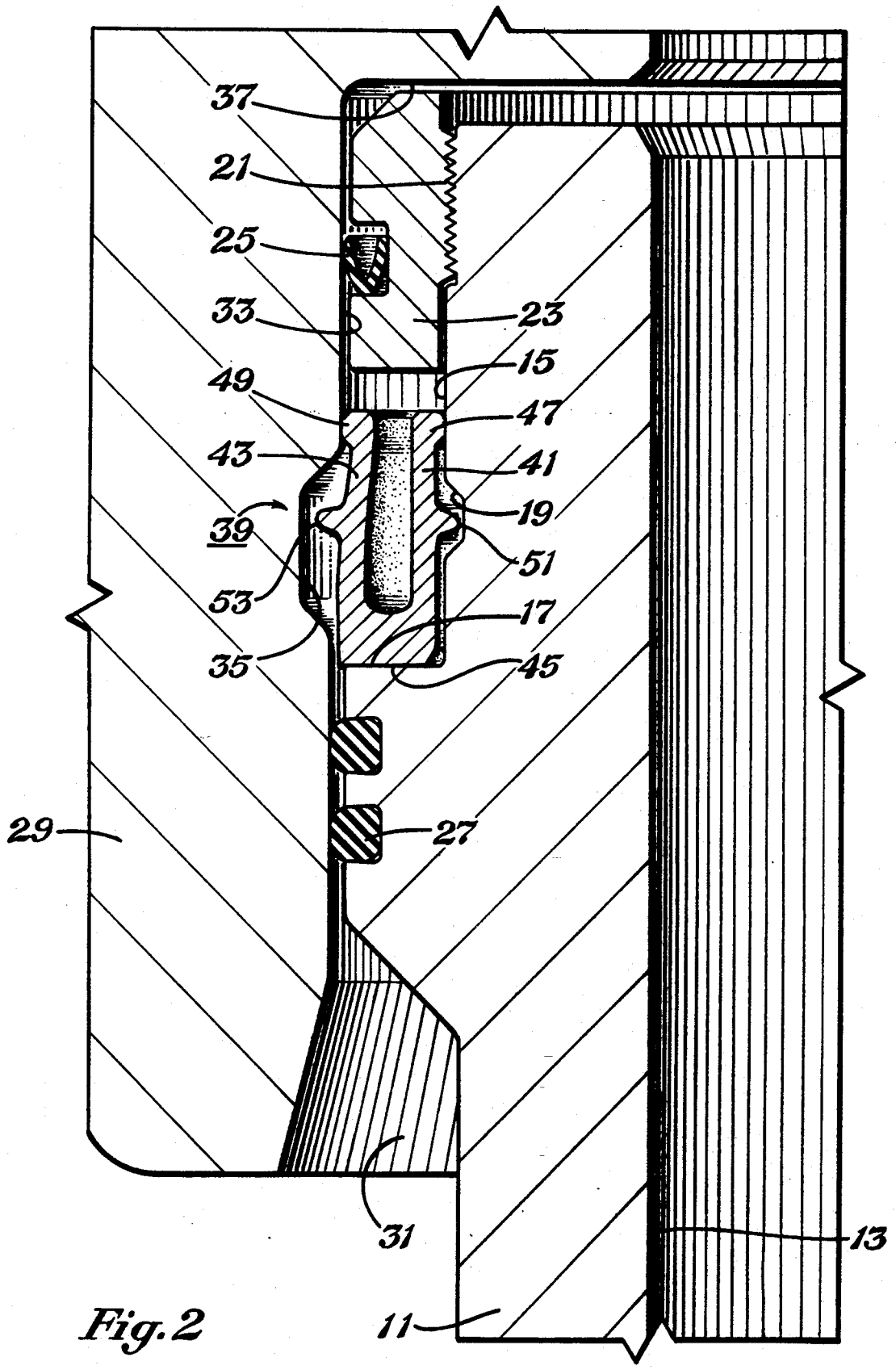
FIG. 2 is a sectional view of the wellhead of FIG. 1, showing the wellhead in an assembled position.

An outer tubular member 29 inserts over inner tubular member 11. Outer tubular member 29 will connect inner tubular member to pressure control equipment located above. Outer tubular member 29 has a bore 31 that is coaxial with bore 13. Outer tubular member 29 has an internal sidewall 33 that will be spaced radially outward from external sidewall 15 once the outer tubular member 29 is fully inserted over inner tubular member 11, as shown in FIG. 2. This results in an annular clearance between the external sidewall surface 15 and internal sidewall surface 33. A recess 35 is formed in internal sidewall surface 33. A downward facing shoulder 37 locates at the upper end of internal sidewall surface 33.

A metal, resilient, seal member 39 seals the annular clearance between external sidewall surface 15 and internal sidewall surface 33. Seal member 39 has an inner wall or leg 41 and an outer wall or leg 43. Inner and outer walls 41, 43 are spaced radially apart and are annular. This results in an annular clearance between inner and outer walls 41, 43. A base 45 joins inner wall 41 to outer wall 43 at the lower end of seal member 39. Base 45 contacts shoulder 17 when seal member 39 is in place.

An inner sealing band 47 locates at the upper end of inner wall 41. Inner sealing band 47 protrudes radially inward for contacting and sealing against external sidewall surface 15. Preferably a coating will be applied to inner sealing band 47. Similarly, an outer sealing band 49 locates at the upper end of outer wall 43. Outer sealing band 49 protrudes radially outward to engage internal sidewall surface 33. Outer sealing band 49 will also be coated with a seal enhancing material.

An inner rib 51 is positioned on the inner surface of inner wall 41. Inner rib 51 is a small protrusion protruding radially from inner wall 41 at least the same distance from inner wall 41 as inner sealing band 47. Inner rib 51 is shown to be annular, but may comprise a plurality of small separated bumps or protrusions extending circumferentially around inner wall 41. Inner rib 51 is positioned above the lower end of seal base 45 a distance that is the same as the distance from shoulder 17 to the center of recess 19. Recess 19 has a radial depth sufficient such that once located in recess 19, a radial clearance will exist between inner rib 51 and the wall surface of recess 19. Inner rib 51 will not perform any sealing function once seal member 39 is installed.

When seal member 39 is pushed down over inner tubular member 11, the rib 51 will contact external sidewall surface 15. This contact deflects inner wall 41 radially outward, radially spacing inner sealing band 47 from external sidewall surface 15. Once rib 51 enters recess 19, the resiliency of inner wall 41 will cause it to spring back radially inward with inner sealing band 47 in tight contact with external sidewall surface 15.

Similarly, an outer rib 53 locates on the exterior of outer wall 43 between base 45 and outer sealing band 49. Outer rib 53 protrudes radially outward at least the same distance as the protrusion of outer sealing band 49. Outer rib 53 is located approximately the same distance above the bottom of seal base 45 as the distance from shoulder 17 to the center of recess 35 when outer tubular member 29 is fully inserted over the inner tubular member 11.

When outer tubular member 29 is inserted over inner tubular member 11, internal sidewall surface 33 will engage outer rib 53, deflecting outer wall 43 radially inward. This radially spaces outer sealing band 49 from internal sidewall surface 33. Once outer rib 53 reaches recess 35, outer wall 43 will spring radially back outward with outer sealing band 49 in sealing contact with internal sidewall surface 33. Once installed, no portion of outer rib 53 will touch the wall surface of recess 35. Outer rib 53 does not perform any sealing once the seal member 39 is installed.

In operation, seal member 39 will be first installed on inner tubular member 11. Prior to securing seal carrier 23, seal member 39 will be moved over threads 21 and external sidewall surface 15. Inner rib 51 will engage external sidewall surface 15 to space inner sealing band 47 from external sidewall surface 15. The operator presses downward on seal member 39 until base 45 contacts shoulder 17. Once inner rib 51 reaches recess 19, the inner wall 41 will spring back radially inward. There will be a slight amount of sliding movement of inner sealing band 47 on external sidewall surface 15 as the seal member 39 moves the final distance down into contact with shoulder 17. The operator then will install the seal carrier 23 and seal 25.

The operator then lowers the outer tubular member 29 over the inner tubular member 11. Initially, outer sealing band 49 will contact a lower portion of internal sidewall surface 33. There will be some sliding movement until outer rib 53 contacts internal sidewall surface 33. Then, outer rib 53 will deflect the outer sealing band 49 radially inward. As the outer tubular member 29 slides downward, the internal sidewall surface 33 will slide on outer rib 53. Subsequently, recess 35 will reach rib outer 53, allowing outer sealing band 49 to spring back radially outward. There will be a slight amount of sliding contact again with outer sealing band 49 as the outer tubular member 29 moves to its final position shown in FIG. 2.

The invention has significant advantages. The ribs reduce the amount of sliding contact required of the sealing bands during installation of the seal and assembly of the inner and outer tubular members. This reduces the wear on the coatings and enhances the sealing.

While the invention has been shown in only one of its forms, it should be apparent to those skilled in the art that it is not so limited, but is susceptible to various changes without departing from the scope of the invention. For example, the seal may be utilized in other tubular applications, such as on the end of a seal sub which attaches to a lower end of a production riser and inserts into the bore of a casing hanger.

I claim:

1. In an apparatus having an inner tubular member having an external sidewall surface, an outer tubular member which receives the inner tubular member, the outer tubular member having an axial bore and an internal sidewall surface that is spaced radially outward from the external sidewall surface, defining an annular clearance, an improved means for sealing the annular clearance, comprising in combination:

an annular, resilient, seal member located in the annular clearance, the seal member having an inner wall and an outer wall radially spaced apart from each other and connected on one end by a base, the inner and outer walls each having a free end opposite the base, the inner wall having a protruding, inner sealing band, located on the free end of the inner wall, that sealingly engages the external sidewall surface, and the outer wall having a protruding, outer sealing band, located on the free end of the inner wall, that sealingly engages the internal sidewall surface when the outer tubular member has fully received the inner tubular member;

a rigid rib located on and protruding from one of the walls of the seal member between the base and one of the sealing bands, the rib engaging one of the sidewall surfaces while the outer tubular member is in the process of receiving the inner tubular member and deflecting said one of the walls of the seal member to prevent said one of the sealing bands from contacting said one of the sidewall surfaces during insertion movement; and an annular recess formed in said one of the sidewall surfaces and spaced to receive the rib when the outer tubular member has fully received the inner tubular member, allowing said one of the walls of the seal member to spring back until said one of the sealing bands sealingly engages said one of the sidewall surfaces.

2. In an apparatus having an inner tubular member having an external sidewall surface, an outer tubular member which receives the inner tubular member, the outer tubular member having an axial bore and an internal sidewall surface that is spaced radially outward from the external sidewall surface, defining an annular clearance, an improved means for sealing the annular clearance, comprising in combination:

an annular, metal, resilient seal member having an inner wall and an outer wall radially spaced apart from each other and connected on one end by a base, the inner and outer walls each having a free end opposite the base, the seal member being located in the annular clearance, the inner wall having a protruding, inner sealing band, located on the free end of the inner wall, that sealingly engages the external sidewall surface, the outer wall having a protruding, outer sealing band, located on the free end of the outer wall, that sealingly engages the internal sidewall surface when the outer tubular member has fully received the inner tubular member;

a rib integrally formed on and protruding from the outer wall of the seal member between the base and the outer sealing band, the rib engaging the internal sidewall surface while the outer tubular member is in the process of receiving the inner tubular member and deflecting the outer wall of the seal member radially inward to prevent the outer sealing band from contacting the internal sidewall surface during insertion movement; and an annular recess formed in the internal sidewall surface and spaced to receive the rib when the outer tubular member has fully received the inner tubular member, allowing the outer wall of the seal member to spring outward until the outer sealing band sealingly engages the internal sidewall surface above the recess.

3. The apparatus according to claim 2 wherein the rib extends circumferentially around the outer wall of the seal member.

4. An improved apparatus for a well, comprising in combination:

an inner tubular member having an external sidewall surface and an annular recess in the external sidewall surface;

an outer tubular member which receives the inner tubular member, the outer tubular member having an axial bore and an internal sidewall surface that is spaced radially outward from the external sidewall surface, the internal sidewall surface having an annular recess formed therein;

an annular, resilient, metal seal member having an inner wall and an outer wall radially spaced apart from each other and connected on one end by a base, the inner and outer walls each having a free end opposite the base, the seal member base being in contact with the shoulder, the inner wall having a protruding, inner sealing band, located at the free end of the inner wall, that sealingly engages the external sidewall surface and the outer wall having a protruding, outer sealing band, located on the free end of the outer wall, that sealingly engages the internal sidewall surface when the outer tubular member has fully received the inner tubular member;

an inner rib located on the inner wall of the seal member between the base and the inner sealing band, the inner rib protruding radially inward and during insertion of the seal member over the inner tubular member engaging the external sidewall surface to deflect the inner wall and reduce contact of the inner sealing band with the external sidewall surface, the inner rib once reaching the recess of the external sidewall surface allowing the inner wall to spring inward to cause the inner sealing band to engage the external sidewall surface; and an outer rib located on the outer wall of the seal member between the base and the outer sealing band, the outer rib protruding radially outward and during insertion of the outer tubular member with the inner tubular member engaging the internal sidewall surface to deflect the outer wall and prevent the outer sealing band from contacting the internal sidewall surface, the outer rib once reaching the recess of the internal sidewall surface allowing the outer wall to spring outward to cause the outer sealing band to engage the internal sidewall surface.

5. A method of sealing an inner tubular member in an outer tubular member, the inner tubular member having an external sidewall surface, the outer tubular member having an axial bore and an internal sidewall surface that is spaced radially outward from the external sidewall surface, comprising:

providing an annular resilient seal member with an inner wall and an outer wall radially spaced apart from each other and connected on one end of a base, the inner and outer wall each having a free end opposite the base;

providing a protruding, inner sealing band located on the free end of the inner wall of the seal member and a protruding outer sealing band located on the free end of the outer wall;

providing a rib on the one of the walls of the seal member between the base and one of the sealing bands;

providing an annular recess in one of the sidewall surfaces to receive the rib;

placing the seal member in engagement with one of the tubular members; then inserting the outer tubular member and the inner tubular member together, causing the rib to engage said one of the sidewall surfaces during insertion movement and to deflect said one of the walls of the seal member radially to prevent said one of the sealing bands from contacting said one of the sidewall surfaces during insertion movement; then locating the rib in the recess once the outer tubular member has fully received the inner tubular member, allowing said one of the walls of the seal member to spring back until said one of the sealing bands sealingly engages said one of the sidewall surfaces.

6. A method of sealing an inner tubular member in an outer tubular member, the inner tubular member having an external sidewall surface, the outer tubular member having an axial bore and an internal sidewall surface that is spaced radially outward from the external sidewall surface, comprising:

providing an annular, resilient, metal seal member with an inner wall and an outer wall radially spaced apart from each other and connected on one end by a base, the inner and outer wall each having a free end opposite the base;

providing a protruding inner sealing band located on the free end of the inner wall of the seal member and a protruding outer sealing band located on the free end of the outer wall of the seal member;

providing a rib on the outer wall of the seal member between the base and the outer sealing band;

providing an annular recess in the internal sidewall surface to receive the rib once the outer tubular member has fully received the inner tubular member;

placing the seal member on the inner tubular member with the inner sealing band in engagement with the external sidewall surface; then inserting the outer tubular member and the inner tubular member together, causing the rib to engage the internal sidewall surface during insertion movement and to deflect the outer wall of the seal member radially inward to prevent the outer sealing band from contacting the internal sidewall surface during insertion movement; then locating the rib in the recess once the outer tubular member has fully received the inner tubular member, allowing the outer wall of the seal member to spring outward until the outer sealing band sealingly engages the internal sidewall surface.

* * * * *